US005298958A

United States Patent [19]

Takahashi

[11] Patent Number: 5,298,958

[45] Date of Patent: Mar. 29, 1994

[54] IMAGE FORMING APPARATUS

[75] Inventor: Kazuhiko Takahashi, Saitama, Japan

[73] Assignee: Fuji Xerox Co., Ltd., Tokyo, Japan

[21] Appl. No.: 884,025

[22] Filed: May 18, 1992

[51] Int. Cl.[5] ..... G03G 21/00

[52] U.S. Cl. ..... 355/317; 355/208; 271/110

[58] Field of Search ..... 271/110; 355/203, 204, 355/208, 309, 311, 317, 321

[56] References Cited

U.S. PATENT DOCUMENTS 4,461,564 7/1984 Ikenoue ..... 355/243
5,043,771 8/1991 Shibata et al. ..... 355/317

FOREIGN PATENT DOCUMENTS 0073281 4/1987 Japan ..... 355/317
0404418 10/1990 United Kingdom ..... 355/309

*Primary Examiner*—Michael L. Gellner
*Assistant Examiner*—P. Stanzione
*Attorney, Agent, or Firm*—Finnegan, Henderson, Farabow, Garrett & Dunner

[57] ABSTRACT

Disclosed is an image forming apparatus such as a laser printer, a copying machine, or the like, for forming an image onto recording paper. The image forming apparatus includes a photoreceptor for rotationally displacing, at a fixed speed, a toner image formed on a surface of the photoreceptor in accordance with image information; feed rolls for feeding, at a fixed speed, recording paper from selected one of a plurality of paper supply portions to a transfer initiation position through corresponding one of recording paper feed paths; a timer which starts counting for each of the paper supply portions from a point of time when feeding of recording paper by the feed rolls is started; a stopping unit for making the feed rolls stop when the timer completes counting of a predetermined time; and a feed roll drive unit for making rotation of the feed rolls restart in response to initiation of arrival of image information. According to the image forming apparatus, a position of image transfer onto the recording paper can be adjusted without using any resist rolls conventionally used to thereby miniaturize the apparatus.

4 Claims, 4 Drawing Sheets

IMAGE FORMING APPARATUS

BACKGROUND OF THE INVENTION

The present invention generally relates to an image forming apparatus such as a laser printer, a copying machine, or the like, for forming an image onto a recording medium, and particularly relates to an image forming apparatus having a plurality of paper supply portions.

A laser printer in which high printing quality is provided is frequently used as an apparatus for printing a document, a chart, or the like, formed by means of an information processor such as a word processor or the like. Further, the formed document or the like is easily copied by using an ordinary electrostatic copying machine.

In each of the laser printer and the copying machine, a photoreceptor drum, a photoreceptor belt, or the like is generally used and an image is formed by transferring a toner image formed on the surface of the photoreceptor body onto recording paper. Generally, such an apparatus has a plurality of paper supply portions, and in order to transfer a toner image on the photoreceptor body onto recording paper at a suitable position, it is necessary to accurately control the timing of transfer. For this, there has been proposed such a following paper supply device as disclosed, for example, in Japanese Patent Unexamined Publication No. Sho. 60-56751.

The paper supply device has such a configuration that a pair of rolls called aligning rolls (hereinafter, referred to as "resist rolls") are provided between paper supply rolls (herein after, referred to as "feed rolls") and a photoreceptor drum so that recording paper fed by the feed rolls is made to hit against the resist rolls so as to stop once, and then the recording paper is fed to the photoreceptor drum by restarting drive of the resist rolls in predetermined timing. That is, a stand-by position of a front end of recording paper is limited by the resist rolls.

In the conventional apparatus, the timing of transfer of an toner image on the photoreceptor drum onto recording paper is adjusted by the resist rolls against which recording paper hits so as to become into a stand-by state as described above. Therefore, existence of the resist rolls is a large obstacle in miniaturizing the apparatus.

SUMMARY OF THE INVENTION

It is therefore an object of the present invention to provide an image forming apparatus in which resist rolls are omitted so as to make it possible to miniaturize the apparatus easily.

In order to attain the above object, the present invention provides an image forming apparatus including: a photoreceptor for rotationally displacing, at a fixed speed, a toner image formed on a surface of the photoreceptor in accordance with image information; feed rolls for feeding, at a fixed speed, recording paper from selected one of a plurality of paper supply portions to a transfer initiation position through corresponding one of recording paper feed paths; a timer which starts counting for each of the paper supply portions from a point of time when feeding of recording paper by the feed rolls is started; stopping means for making the feed rolls stop when the timer completes counting of a predetermined time; and feed roll drive means for making rotation of the feed rolls restart in response to initiation of arrival of image information.

DETAILED DESCRIPTION OF THE PREFERRED EMBODIMENT

A laser printer which is an embodiment of the present invention will be described in detail.

Figure 1:
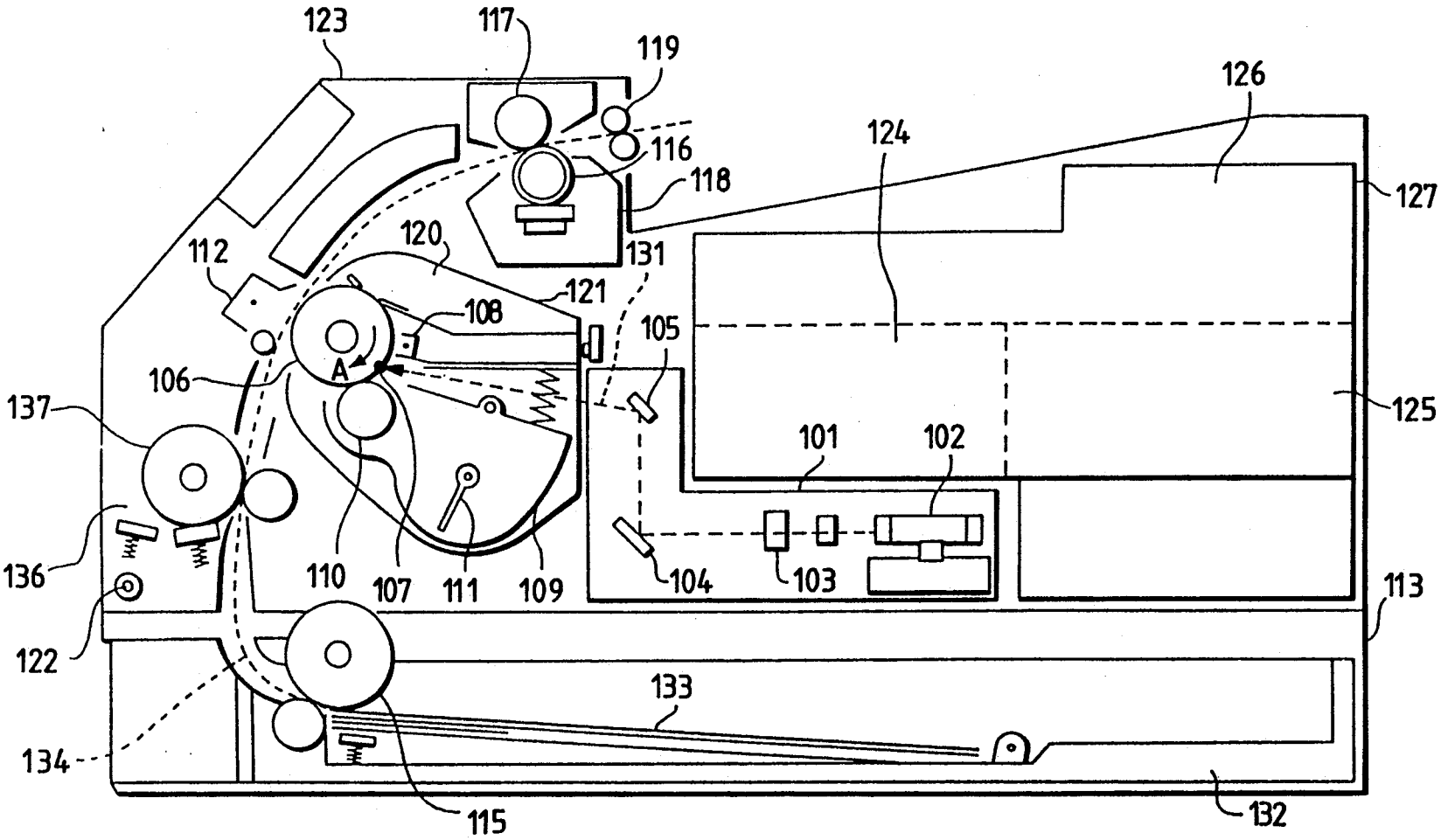
FIG. 1 is a schematic diagram showing the configuration of a laser printer which is an embodiment of the present invention.

FIG. 1 is a schematic diagram showing the configuration of a laser printer which is an embodiment of the image forming apparatus according to the present invention. In the drawing, the laser printer is viewed from its side surface, and the left-hand in the drawing corresponds to the front surface of the laser printer.

The laser printer 100 has a laser scanner 101. In the laser scanner 101, arranged is a semiconductor laser (not shown) which modulates laser light in accordance with an image signal and outputs the modulated laser light. A laser beam (broken line in the drawing) emitted from the semiconductor laser is incident into a polygon mirror 102 rotating at a fixed speed and deflected in accordance with the rotation of the polygon mirror 102. After passed through an f+74(0) lens 103, the deflected laser beam is changed in its traveling direction by mirrors 104 and 105 and outputted from the laser scanner 101.

A photoreceptor drum 106 which rotates in the direction of an arrow A shown in the drawing is arranged on an extension of the laser beam outputted from the laser scanner 101. The laser beam outputted from the laser scanner 101 repeatedly scans a predetermined exposure position 107 of the photoreceptor drum 106 in the direction of the axis of the photoreceptor drum 106, that is, in the main scanning direction. A charge corotron 108 is provided in a position in opposition to the photoreceptor drum 106 slightly before the exposure position 107 so that the surface of the photoreceptor drum 106 is uniformly charged. The charged photoreceptor drum 106 is irradiated with the laser beam 131 so that an electrostatic latent image corresponding to image information is formed on the drum surface. The electrostatic latent image is developed by a developing device 109 at a portion of the drum surface downstream the exposure position 107. Members such as a developing roll 110 for developing an electrostatic latent image by means of magnetically spiked toner, a toner supply mechanism 111 for supplying the developing roll 110 with toner out of a cartridge, and the like, are provided in the developing device 109. A predetermined development bias voltage is applied to the developing roll 110.

The toner image formed through development by the developing device 109 is moved to a position opposite to a transfer corotron 112 as the photoreceptor drum 106 rotates, and electrostatically transferred onto recording paper (ordinary paper). Each of the charge and transfer corotrons 108 and 112 used in this example has such a configuration that a single corotron wire is stretched between an earth and a voltage application terminal.

Next, a feed path for recording paper will be briefly described. The laser printer has two paper supply devices. A first paper supply device 136 is of the manual insertion type in which sheets of paper having various sizes are supplied through manual insertion. The paper manually inserted is fed out onto a feed path 134 by a pair of feed rolls 137.

A second paper supply device 113 is removably disposed in a lower portion of the laser printer, and a cassette tray 132 in which sheets of recording paper are stacked are inserted from the front surface of the second paper supply device 113. Recording paper 133 disposed in the uppermost layer in the cassette tray 132 is fed out onto the feed path 134 by a pair of feed rolls 115.

Recording paper sent out of the first paper supply device 136 is fed by the feed rolls 137 along the feed path 134, and the advancing of the recording paper is stopped by stopping the feed rolls 137 at a point of time when a predetermined time has elapsed from initiation of feeding. Thereafter, when formation of an image onto the photoreceptor drum 106 is started, the rotation of the feed rolls 137 is restarted in synchronism with the rotational position of the formed toner image, and the stable feeding of the recording paper at a fixed speed is started.

Similarly to this, the recording paper 133 sent out of the cassette tray 132 of the second paper supply device 113 is fed by the feed rolls 115 along the feed path 134, and the advancing of the recording paper 133 is stopped by stopping the feed rolls 115 at a point of time when a predetermined time has elapsed from initiation of feeding. Thereafter, when formation of an image onto the photoreceptor drum 106 is started, the rotation of the feed rolls 115 is restarted in synchronism with the rotational position of the formed toner image, and the stable feeding of the recording paper 133 at a fixed speed is started.

Thus, the recording paper passes through in timing between the photoreceptor drum 106 and the transfer corotron 112. The transfer corotron 112 performs discharging only at the time of this passage of the recording paper so that the toner image on the photoreceptor drum 106 is electrostatically attracted toward the transfer corotron 112 and transferred onto the recording paper.

The recording paper after subjected to toner image transfer is discharged from its back surface by means of erasure needles (not shown) arranged downstream the transfer corotron 112 so that the recording paper is separated from the surface of the photoreceptor drum 106. After fed along a feed path of a predetermined length so as to release its tension, the recording paper separated from the drum surface is sent to a fusing device 118 constituted by a pair of rolls, that is, a heat roll 116 and a pressure roll 117.

In the fusing device 118, the recording paper passes through between the heat and pressure rolls 116 and 117 which are nipping over a predetermined width. At this time, the recording paper is arranged so as to make its surface carrying the toner image transferred thereto face the heat roll 116 so that the recording paper is pressed by the pressure roll 117 against the heat roll 116 so as to make the heat conduction be performed efficiently. The heat roll 116 is controlled to be at a fixed high temperature. In this state, the toner image on the recording paper is thermally fixed on the paper surface.

Outlet rolls 119 are provided in the outlet of the fusing device 118, and the recording paper is discharged by the outlet rolls 119 into an upper portion of the laser printer. The recording paper in the state where the recording surface turns downward is discharged because it is fed through the foregoing path, and sheets of recording paper successively printed page by page can be bound as they are in the discharged order by using a stapler.

The toner image which has not been transferred onto recording paper, on the contrary, is removed from the drum surface by a cleaning device 120 arranged downstream the transfer corotron 112. The cleaning device 120 is provided with a blade for scraping toner from the drum surface, and so on.

In this laser printer, the photoreceptor drum 106, the cleaning device 120, the charge corotron 108, and the developing device 109 are integrally provided with each other as a process cartridge 121. A front cover 123 is arranged so as to open/close about a hinge 122, so that a user can very easily perform removal of paper jamming and exchange of the process cartridge 121 and the transfer corotron 112, attachment/removal of the fusing device 118, and so on.

A low voltage power source (not shown) and a high voltage power source 124 are arranged behind the laser scanner 101 so as to supply the constituent blocks with required electric power. A controller 125 is arranged behind the high voltage power source 124 so as to electrically control the whole of the laser printer. An image information processor 126 is disposed above the high voltage power source 124 and the controller 25 so as to send image information from a host computer or the like to the controller 125 after the image information has been converted into a laser beam modulation signal of the laser beam printer.

Figure 2:
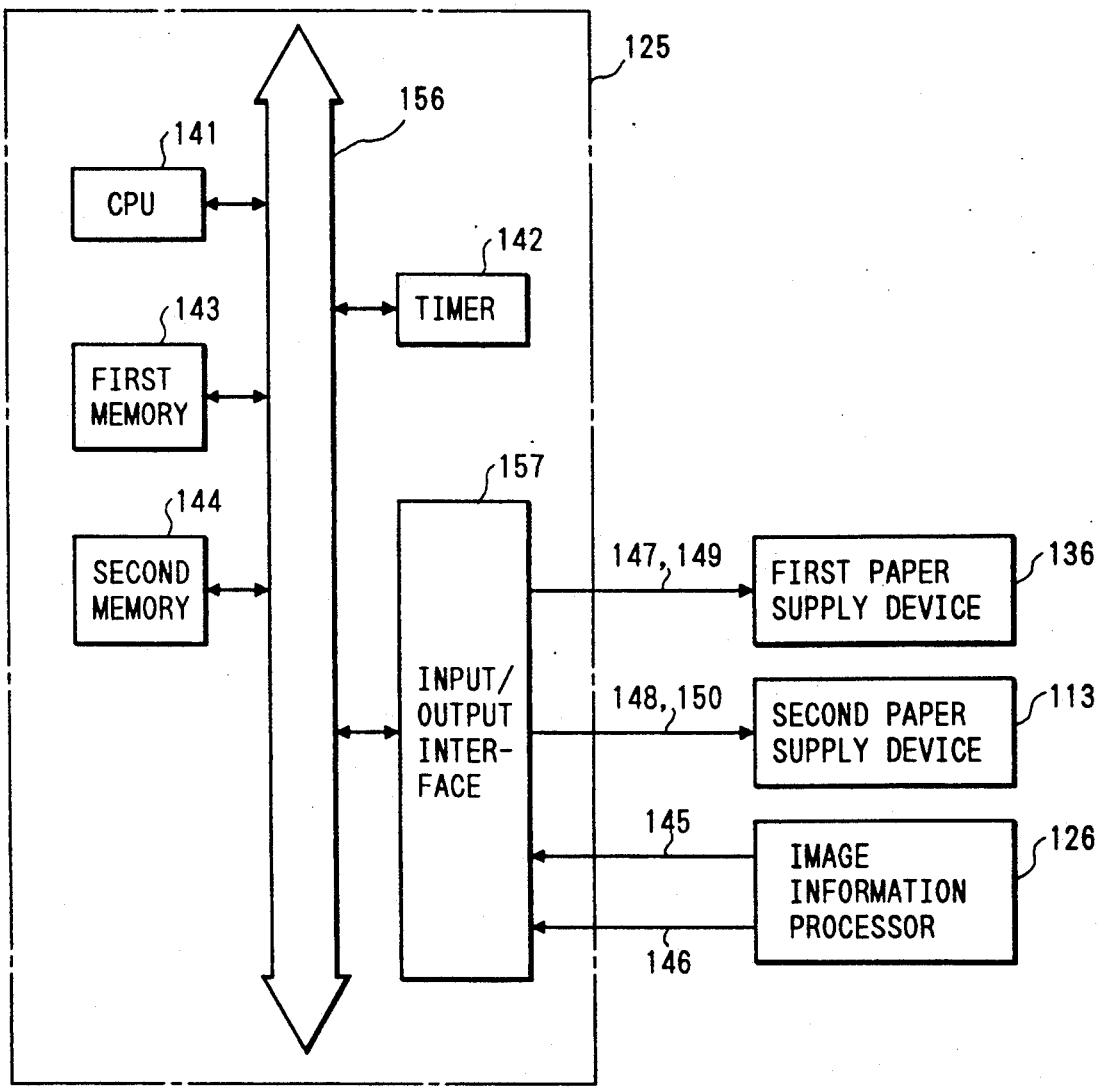
FIG. 2 is a block diagram showing a controller in the laser printer in detail.

FIG. 2 shows a main part of the controller 125. The controller 125 has a central processor unit (hereinafter, referred to as "CPU") 141 for controlling the operation of the whole controller, the CPU being connected, through a bus 156, to a timer 142, first and second memories 143 and 144, and an input/output interface 157.

Timing data concerning the first and second paper supply devices 136 and 113 are stored in the first and second memories 143 and 144 respectively, and the timer 142 is arranged so as to count time corresponding to the timing data.

Further, the CPU 141 is supplied with a paper supply initiation signal 145 and an image output initiation signal 146 which are sent from the image information processor 126 (FIG. 1) through the input/output interface 157 and the bus 156, and, on the contrary, outputs roll drive signals 147 and 148 or roll stopping signals 149 and 150 to the first and second paper supply devices 136 and 113 respectively.

Figure 3:
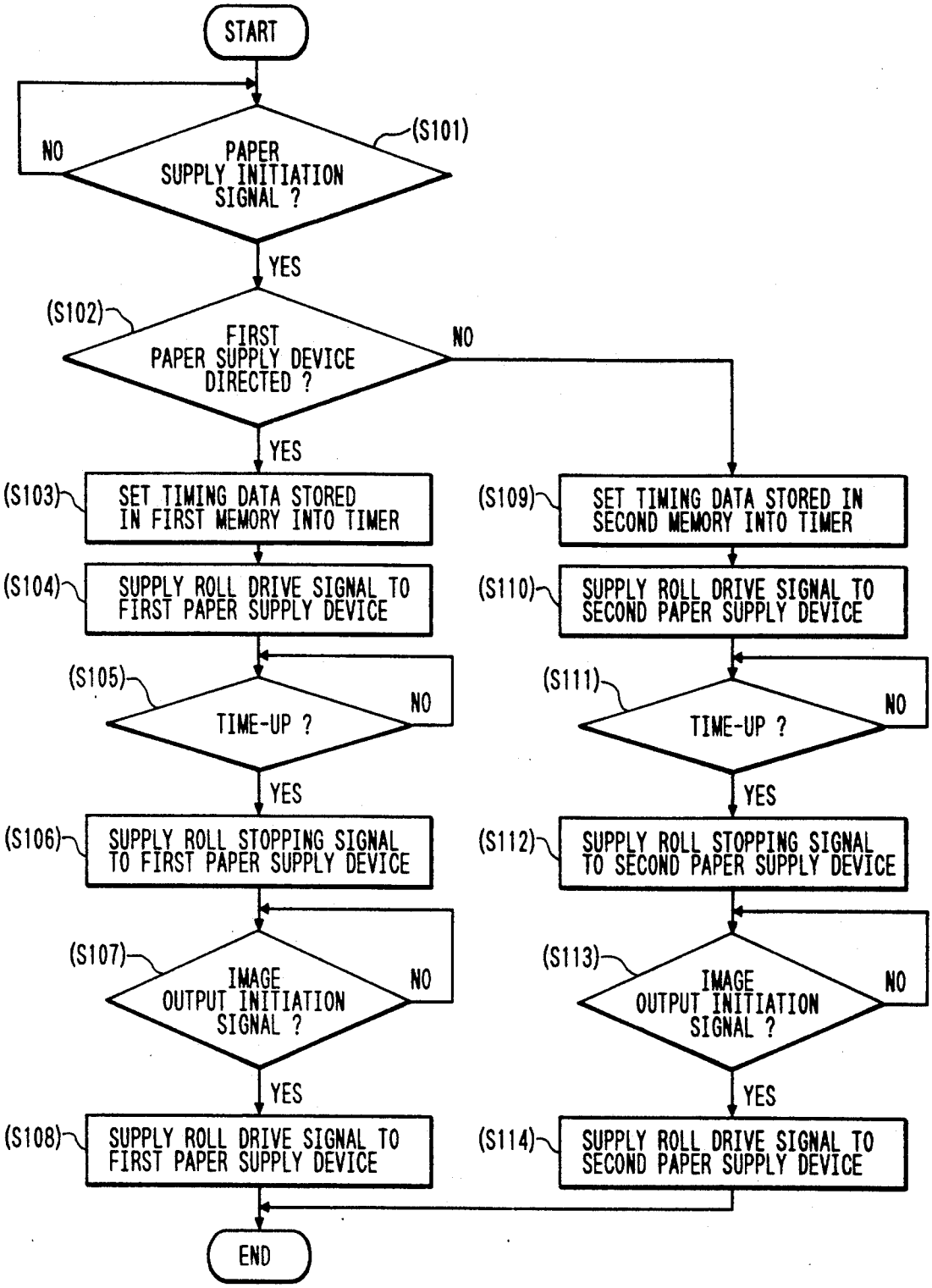
FIG. 3 is a flowchart for explaining the operation of the controller.

Next, referring to FIG. 3, the paper supply operation will be described around the controller 125.

Upon reception of the paper supply initiation signal 145 from the image information processor 126 (step S101), the CPU 141 makes a judgement as to which one of the first and second paper supply devices is directed by the signal 145 (step S102).

Figure 4:
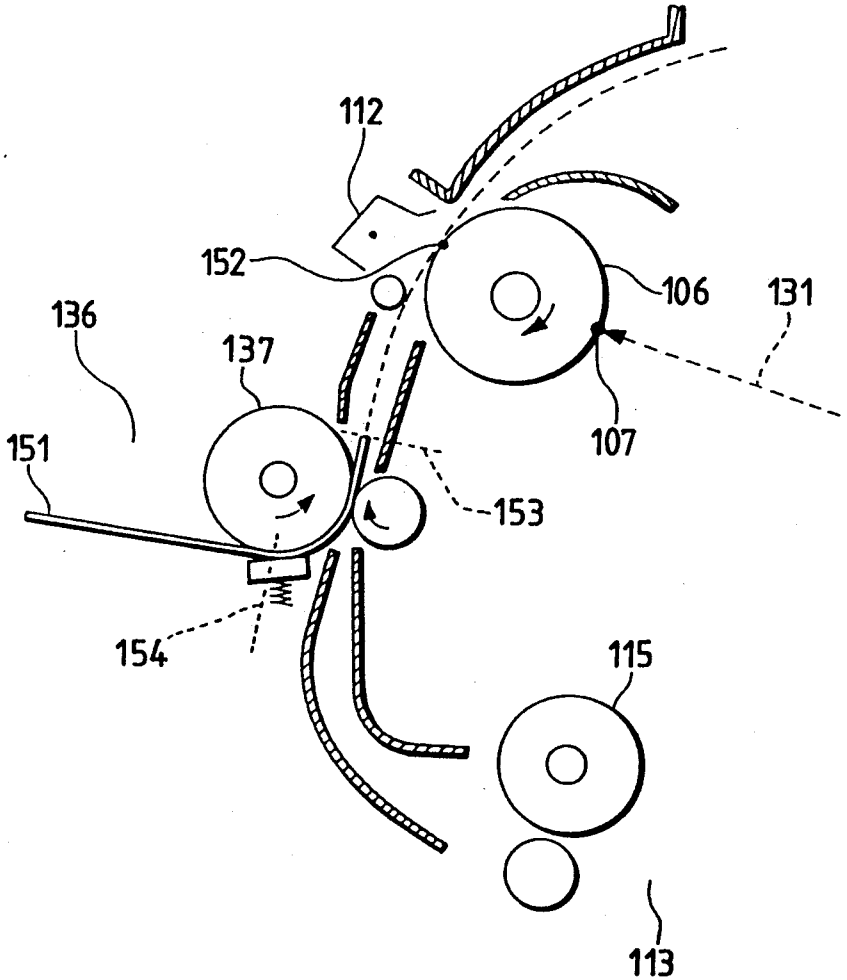
FIG. 4 is a diagram for explaining the operation for feeding recording paper from a first paper supply device of the laser printer.

If the judgement proves that the signal is directed to the first paper supply device 136 (Y), the CPU 141 reads timing data stored in advance in the first memory 143 and sets the data into the timer 142 (step S103). Then, the CPU 141 supplies the roll drive signal 147 to the first paper supply device 136 (step S104). As shown in FIG. 4, the timing data means time required from the start of feeding of recording paper 151 by the feed rolls 137 of the first paper supply device 136 to the arrival of a front end of the recording paper 151 at an imaginary resist position 153 shown by a broken line in the drawing. The imaginary resist position 153 corresponds to a stand-by position of recording paper limited by the resist rolls in the conventional apparatus. That is, the time required for feeding recording paper from the imaginary resist position 153 to the transfer position 152 is set in advance so as to be equal to the time till a front end of an image exposed on the photoreceptor drum 106 at the exposure position 107 reaches the transfer position 152. The time data may be stored in a memory (not shown) or the like.

The feed rolls 137 of the first paper supply device 136 start feeding of the recording paper 151 in response to the roll drive signal 147.

Upon completion of counting till a set time (step S105; Y), the timer 142 supplies a time-up signal to the CPU 141. Receiving the time-up signal, the CPU 141 supplies the roll stopping signal 149 to the first paper supply device 136 (step S106). As a result, the front end of the recording paper 151 stops at the imaginary resist position 153 as shown in FIG. 4.

Upon reception of the image output initiation signal 146 from the image information processor 126 (step S107; Y), the CPU 141 supplies the roll drive signal 147 again to the first paper supply device 136 (step S108) so that the feeding of the recording paper 151 by the feed rolls 137 is restarted.

Then, the recording paper 151 passes through between the photoreceptor drum 106 and the transfer corotron 112 in timing so that the toner image is transferred onto the recording paper 151 at its correct position.

If a judgement in step 102 proves that the paper supply initiation signal 145 is directed to the second paper supply device 113 (N), on the contrary, the CPU 141 reads timing data previously stored in the second memory 144 and sets the read-out data into the timer 142 (step S109). Then, the CPU 141 supplies the roll drive signal 148 to the second paper supply device 113 (step S110).

Figure 5:
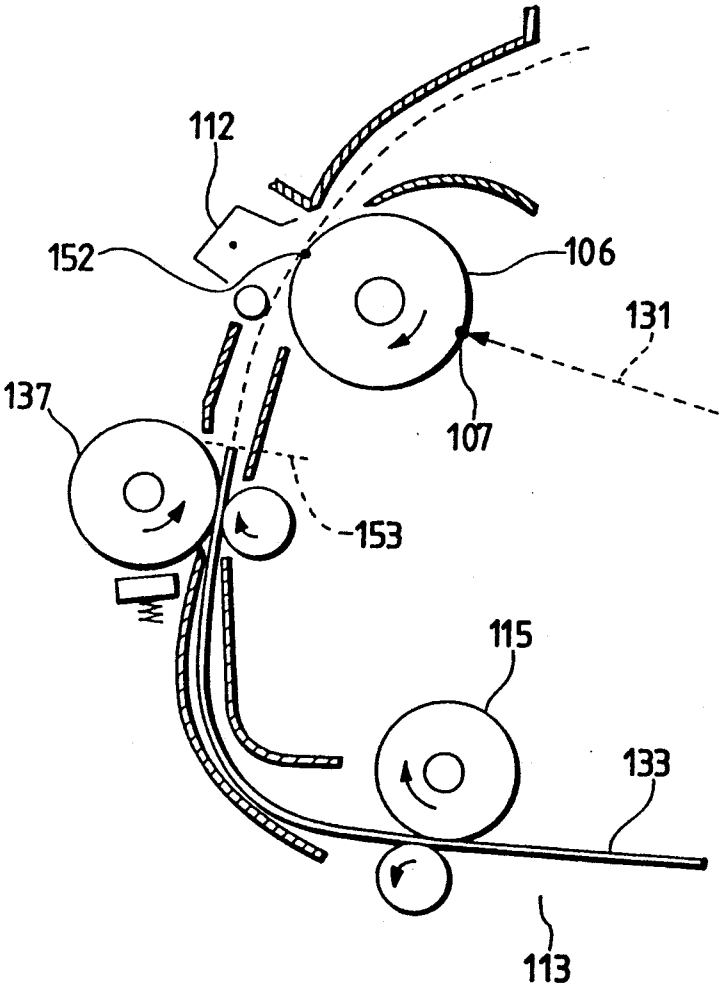
FIG. 5 is a diagram for explaining the operation for feeding recording paper from a second paper supply device of the laser printer.

As shown in FIG. 5, the timing data is a period of time required from the initiation of feeding of the recording paper 133 by the feed rolls 115 of the second paper supply device 113 to the arrival of a front end of the recording paper 133 at the imaginary resist position 153 shown by a broken line in the drawing. The imaginary resist position 153 is the same as that shown in FIG. 4. As described above, therefore, the period of time required for the recording paper 133 to be fed from the imaginary resist position 153 to the transfer position 152 is made equal to the period of time required for the front end of the image exposed at the exposure position 107 on the photoreceptor drum 106 to be fed from the exposure position 107 to the arrival at the transfer position 152.

Upon reception of the roll drive signal 148, the feed rolls 115 of the second paper supply device 113 starts feeding of the recording paper 133.

Upon completion of counting till a set time (step S111; Y), the timer 142 supplies a time-up signal to the CPU 141. Receiving the time-up signal, the CPU 141 supplies the roll stopping signal 150 to the second paper supply device 113 (step S112). As a result, the front end of the recording paper 133 stops at the imaginary resist position 153 as shown in FIG. 5.

Upon reception of the image output initiation signal 146 from the image information processor 126 (step S113; Y), the CPU 141 supplies the roll drive signal 148 again to the second paper supply device 113 (step S114) so that the feeding of the recording paper 133 by the feed rolls 115 is restarted.

Then, the recording paper 133 passes through between the photoreceptor drum 106 and the transfer corotron 112 in timing so that the toner image is transferred onto the recording paper 133 at its correct position.

Although the timer 142 is made to start counting from the initiation of driving of the feed rolls 115 or 137 in this embodiment, the configuration may be modified such that a recording paper detecting sensor is provided before the imaginary resist position 153 so that the timer 142 may be made to start counting from the point of time when the sensor detects the front end of recording paper. In such a case, a feed error due to a slip or the like of the feed rolls 115 or 137 can be absorbed to thereby make it possible to more accurately adjust the resist position.

Further, although the imaginary resist position 153 is set at such a position as shown in FIG. 4 or 5 in this embodiment, for example, a recording paper set position 154 (FIG. 4) in the first paper supply device 136 may be set as the imaginary resist position. In such a case, it will do to arrange the constituent parts so that the period of time required for the front end of the recording paper 151 to be fed from the recording paper set position 154 to the photoreceptor drum 106 is equal to the period of time required for the image exposed at the exposure position 107 on the photoreceptor drum 106 to be fed from the exposure position 107 to the arrival at the transfer position 152, and the feed rolls 137 are started to be driven at the timing of the image output initiation signal 146 from the image information processor 126. This can be realized by making the timing data to be set in the first memory 143 (FIG. 2) be "0".

Moreover, although description has been made as to the case of using two paper supply devices in this embodiment, it is a matter of course that the present invention is applicable easily even to the case where three or more paper supply devices are used under the same control as in the above embodiment with timing data stored in a memory correspondingly to the respective paper supply devices.

It goes without saying that such a configuration for setting a resist position as described in this embodiment can be applied to an ordinary copying machine.

As described above, according to the present invention, the feed rolls are stopped once after lapsing a predetermined time from the start of feeding of recording paper by the feed rolls to thereby set the resist position, and it is therefore possible to eliminate the resist rolls. Consequently, there is such an effect that the apparatus can be miniaturized easily.

What is claimed is:

1. An image forming apparatus comprising:

a photoreceptor for rotationally displacing, at a fixed speed, a toner image formed on a surface of said photoreceptor in accordance with image information;

feed rolls for feeding, at a fixed speed, recording paper from selected one of a plurality of paper supply portions to a transfer initiation position through corresponding one of recording paper feed paths;

a timer which starts counting for each of said paper supply portions from a point of time when feeding of recording paper by said feed rolls is started;

stopping means for making said feed rolls stop when said timer completes counting of a predetermined time; and feed roll drive means for making rotation of said feed rolls restart in response to initiation of arrival of image information.

2. The image forming apparatus according to claim 1, further comprising memory means in which data of the predetermined time to be counted by said timer is stored.

3. The image forming apparatus according to claim 1, wherein a time required for feeding recording paper from a position where the recording paper has stopped by stoppage of said feed rolls to the transfer initiation position is set in advance so as to be equal to a time till a leading edge of an image exposed on said photoreceptor at an exposure position reaches the transfer initiation position.

4. An image forming apparatus comprising:

a photoreceptor for rotationally displacing, at a fixed speed, a toner image formed on a surface of said photoreceptor in accordance with image information;

a first memory for previously storing a time necessary for a front end of said toner image to reach an initiation position of transfer to recording paper from an exposure position;

recording paper feed paths respectively provided from a plurality of paper supply portions corresponding to kinds of recording paper to said transfer initiation position;

feed rolls for feeding, at a fixed speed, recording paper from a selected one of said paper supply portions through a corresponding one of said recording paper feed paths;

a second memory for previously storing, for each of said paper supply portions, a time necessary for a leading edge of the recording paper to come from said paper supply portion corresponding to the recording paper to a position farther along said feed path, said farther position being a distance away from the transfer initiation position, said distance corresponding to the necessary time stored in said first memory;

a timer for counting, for each of said paper supply portions, from a point of time when feeding of recording paper by said feed rolls is started, and for outputting a signal for making said feed rolls stop when the time stored in said second memory elapses; and instruction means for instructing said feed rolls to restart rotation in response to initiation of arrival of image information.

* * * * *